US005645935A

United States Patent [19]

Kemper et al.

[11] Patent Number: 5,645,935

[45] Date of Patent: Jul. 8, 1997

[54] TWO-COMPONENT LOOP YARNS COMPRISING ARAMID FILAMENTS, MANUFACTURE THEREOF AND USE THEREOF

[75] Inventors: Wilbert Kemper, Bobingen; Richard Neuert, Winkelhaid, both of Germany

[73] Assignee: Hoechst Trevira GmbH & Co. KG, Germany

[21] Appl. No.: 567,289

[22] Filed: Dec. 5, 1995

[30] Foreign Application Priority Data

Dec. 7, 1994 [DE] Germany ..... 44 43 456.1

[51] Int. Cl.[6] ..... D02G 3/00

[52] U.S. Cl. ..... 428/370; 428/369; 428/399; 428/395; 57/903

[58] Field of Search ..... 428/395, 370, 428/373, 369, 399; 57/6, 247, 903

[56] References Cited

U.S. PATENT DOCUMENTS

| | | | |
|---|---|---|---|
| 4,847,354 | 7/1989 | Keil et al. | 528/340 |
| 4,987,215 | 1/1991 | Keil et al. | 528/329.1 |
| 4,987,216 | 1/1991 | Keil et al. | 528/340 |
| 4,987,217 | 1/1991 | Keil et al. | 528/340 |
| 5,083,419 | 1/1992 | Greifeneder et al. | 57/6 |
| 5,097,015 | 3/1992 | Meiss et al. | 528/331 |
| 5,100,729 | 3/1992 | Jacob et al. | 428/370 |
| 5,429,868 | 7/1995 | Truckenmüller et al. | 428/868 |
| 5,478,648 | 12/1995 | Stein et al. | 428/375 |

FOREIGN PATENT DOCUMENTS

SG 888/92 1/1996 Singapore .

*Primary Examiner*—Newton Edwards
*Attorney, Agent, or Firm*—Connolly & Hutz

[57] ABSTRACT

Two-component loop yarns are composed of core and effect filaments, at least part of the core component consisting of aromatic polyamides, wherein the aromatic polyamides contain the structural repeat units of the formulae I and II $$—OC—Ar^1—CO—NH—Ar^2—NH— \quad (I)$$

$$—OC—Ar^1—CO—NH—Ar^3—NH— \quad (II),$$

where $Ar^1$, $Ar^2$ and $Ar^3$ are each independently of the others a bivalent mono- or polycyclic aromatic radical whose free valences are disposed para or meta or comparably parallel, coaxial or angled to each other, and $Ar^2$ and $Ar^3$ each have different individual meanings within the scope of the given definitions, and the respective monomer components underlying the polymer are selected so as to produce an aromatic polyamide which forms preferably isotropic solutions in organic solvents.

13 Claims, No Drawings

TWO-COMPONENT LOOP YARNS COMPRISING ARAMID FILAMENTS, MANUFACTURE THEREOF AND USE THEREOF

The present invention relates to novel two-component loop yarns, to adapted processes for producing them, and to the use of these yarns as sewing and embroidery yarns.

The field of sewing yarns has recently come to include loop yarns composed of core and effect filaments. Loop yarns which are particularly useful as sewing yarns are described for example in EP-A-295,601, EP-A-367,938 and EP-A-363,798. These references deal in the main with loop yarns based on polyester yarns. The use of other polymers is mentioned, but not more particularly described.

The development of such loop yarns was chiefly aimed at producing particularly high strengths.

Aromatic polyamides (aramids) are well known raw materials of high thermal and chemical stability and also low flammability. Furthermore, fibers composed of such raw materials have very good mechanical properties, such as high strength and high initial modulus (modulus of elasticity).

Furthermore, aromatic copolyamides have already been disclosed which are readily soluble in the known amide solvents, which are also readily spinnable and whose filaments have high strength values and initial moduli after drawing. Examples of such aromatic copolyamides are described in DE-C-2,556,883, DE-C-3,007,063, EP-A-199,090, EP-A-364,891, EP-A-364,892, EP-A-364,893 and EP-A-424,860.

The present invention provides a loop yarn which takes advantage of the well known good mechanical properties of aramids.

It has now been found that blow texturing can be used to produce loop yarns having particularly good sewing characteristics and good seam formation. The two-component loop yarns of the present invention are highly useful as sewing and embroidery yarns.

The present invention accordingly provides a two-component loop yarn composed of core and effect filaments, at least part of the core component, preferably the entire core components, consisting of aromatic polyamides, wherein the aromatic polyamides contain the structural repeat units of the formulae I and II $$—OC—Ar^1—CO—NH—Ar^2—NH— \quad (I)$$

$$—OC—Ar^1—CO—NH—Ar^3—NH— \quad (II),$$

where $Ar^1$, $Ar^2$ and $Ar^3$ are each independently of the others a bivalent mono- or polycyclic aromatic radical whose free valences are disposed para or meta or comparably parallel, coaxial or angled to each other, and $Ar^2$ and $Ar^3$ each have different individual meanings within the scope of the given definitions, and the respective monomer components underlying the polymer are selected so as to produce an aromatic polyamide which forms preferably isotropic solutions in organic solvents.

A soluble aromatic polyamide for the purposes of this invention is any aromatic polyamide which has a solubility in N-methylpyrrolidone of at least 50 g/l at 25° C.

The polar aprotic organic solvent preferably comprises at least one solvent of the amide type, for example N-methyl-2-pyrrolidone, N,N-dimethylacetamide, tetramethylurea, N-methyl-2-piperidone, N,N'-dimethylethyleneurea, N,N,N',N'-tetramethylmaleamide, N-methylcaprolactam, N-acetylpyrrolidine, N,N-diethylacetamide, N-ethyl-2-pyrrolidone, N,N'-dimethylpropionamide, N,N-dimethylisobutylamide, N-methylformamide, N,N'-dimethylpropyleneurea. The preferred organic solvents for the process of the present invention are N-methyl-2-pyrrolidone, N,N-dimethylacetamide and a mixture thereof.

Any bivalent aromatic radicals whose valency bonds are disposed para or comparably coaxial or parallel to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be bonded linearly to one another via C—C bonds or via -CO-NH- groups.

The valence bonds in mutually coaxial or parallel disposition point in opposite directions. An example of coaxial bonds pointing in opposite directions are the biphenyl-4,4'-ene bonds. An example of parallel bonds pointing in opposite directions are the naphthalene-1,5 or -2,6 bonds, whereas the naphthalene-1,8 bonds are parallel but point in the same direction.

Examples of preferred bivalent aromatic radicals whose valence bonds are disposed para or comparably coaxial or parallel to each other are monocyclic aromatic radicals having free valences disposed para to each other, especially 1,4-phenylene, or bicyclic fused aromatic radicals having parallel bonds pointing in opposite directions, especially 1,4-, 1,5- and 2,6-naphthylene, or bicyclic aromatic radicals linked via a C—C bond but having coaxial bonds pointing in opposite directions, especially 4,4'-biphenylene.

Any bivalent aromatic radicals whose valence bonds are disposed meta or comparably angled to each other are monocyclic or polycyclic aromatic hydrocarbon radicals or heterocyclic aromatic radicals which can be monocyclic or polycyclic. Heterocyclic aromatic radicals have in particular one or two oxygen, nitrogen or sulfur atoms in the aromatic nucleus.

Polycyclic aromatic radicals can be fused to one another or be linked to one another via C—C bonds or via bridging groups, for example —O—, —$CH_2$—, —S—, —CO— or —$SO_2$—.

Examples of preferred bivalent aromatic radicals whose valence bonds are disposed meta or comparably angled to each other are monocyclic aromatic radicals having free valences disposed meta to each other, especially 1,3-phenylene, or bicyclic fused aromatic radicals having mutually angled bonds, in particular 1,6- and 2,7-naphthylene, or bicyclic aromatic radicals linked via a C—C bond and having mutually angled bonds, especially 3,4'-biphenylene.

Minor proportions, for example to 5 mol%, of the monomer units, based on the polymer, can be aliphatic or cycloaliphatic in nature, for example alkylene or cycloalkylene units.

Alkylene is to be understood as meaning branched and especially straight-chain alkylene, for example alkylene having two to four carbon atoms, especially ethylene.

Cycloalkylene radicals are for example radicals having five to eight carbon atoms, especially cycloalkylene.

All these aliphatic, cycloaliphatic or aromatic radicals can be substituted by inert groups. These are substituents which have no adverse effect on the contemplated application.

Examples of such substituents are alkyl, alkoxy or halogen.

Alkyl is to be understood as meaning branched and especially straight-chain alkyl, for example alkyl having one to six carbon atoms, especially methyl.

Alkoxy is to be understood as meaning branched and especially straight-chain alkoxy, for example alkoxy having one to six carbon atoms, especially methoxy.

Halogen is for example fluorine, bromine or in particular chlorine.

Preference is given to aromatic polyamides based on unsubstituted radicals.

The dicarboxylic acid unit in the aromatic polyamides comprising the structural repeat units of the formulae I and II is preferably terephthalic acid.

The preferred yarns comprise core filaments and preferably also effect filaments comprising aromatic copolyamides comprising structural repeat units of the formulae III and IV or of the formulae III and VI or of the formulae III, IV and V or of the formulae III, IV and VI or of the formulae IV, V and VI $$-OC-Ar^1-CO-NH-Ar^4-NH-, \quad (III)$$

$$-OC-Ar^1-CO-NH-Ar^5-Q-Ar^6-NH-, \quad (IV)$$

$$-OC-Ar^1-CO-NH-Ar^7-Y-Ar^8-NH-, \quad (V)$$

(VI)

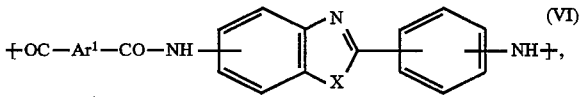

where $Ar^1$ and $Ar^4$ are independently of each other a bivalent mono- or polycyclic aromatic radical whose free valences are disposed para or comparably parallel or coaxial to each other, and are in particular monocyclic or bicyclic aromatic radicals, $Ar^5$ and $Ar^6$ are each independently of the other a bivalent mono- or polycyclic aromatic radical whose free valences are disposed para or comparably parallel or coaxial to each other, or where $Ar^6$ additionally may be a bivalent mono- or polycyclic aromatic radical whose free valences are disposed meta or comparably angled to each other, Q is a C—C bond or a group of the formula —O—, —S—, —$SO_2$—, -O-phenylene-O- or alkylene, $Ar^7$ and $Ar^8$ each have one of the meanings defined for $Ar^5$ and $Ar^6$, Y has one of the meanings defined for Q or may additionally be a group of the formula —HN—CO—, and X is a group of the formula —O—, —S— or in particular —$NR^1$—, where $R^1$ is alkyl, cycloalkyl, aryl, aralkyl or in particular hydrogen.

Particular preference is given to yarns comprising as core filaments and preferably also as effect filaments aromatic copolyamides with the structural repeat units of the formulae III, IV and V where $Ar^1$ is 1,4-phenylene, $Ar^4$ is 1,4-phenylene or a bivalent radical of 4,4'-diaminobenzanilide, $Ar^5$, $Ar^6$ and $Ar^7$ are each 1,4-phenylene, $Ar^8$ is 1,3-phenylene, Q is —O-1,4-phenylene-O—, and Y is —O—; and in particular the proportions of the structural repeat units of the formulae III, IV and V vary within the following ranges, based on the total amount of these structural units:

structural repeat unit of the formula III: 40–60 mol %,
structural repeat unit of the formula IV: 1–20 mol %, and
structural repeat unit of the formula V: 15–40 mol %.

Particular preference is likewise given to yarns comprising as core filaments and preferably also as effect filaments aromatic copolyamides with the structural repeat units of the formulae III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-substituted 1,4-phenylene, Q is —O-1,4-phenylene-O— and Y is a C—C bond; and in particular the proportions of the structural repeat units of the formulae III, IV and V vary within the following ranges, based on the total amount of these structural units:

structural repeat unit of the formula III: 10–30 mol %,
structural repeat unit of the formula IV: 10–30 mol %, and
structural repeat unit of the formula V: 10–60 mol %.

Particular preference is likewise given to yarns comprising as core filaments and preferably also as effect filaments aromatic copolyamides with the structural repeat units of the formulae III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-substituted 1,4-phenylene, Q is —O— and Y is a C—C bond; and in particular the proportions of the structural repeat units of the formulae III, IV and V vary within the following ranges, based on the total amount of these structural units:

structural repeat unit of formula III: 10–30 mol %,
structural repeat unit of formula IV: 10–50 mol %, and
structural repeat unit of formula V: 10–60 mol %.

Particular preference is likewise given to yarns comprising as core filaments and preferably also as effect filaments aromatic copolyamides with the structural repeat units of the formulae III and IV where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,3-phenylene and Q is —O—; and in particular the proportions of the structural repeat units of the formulae III and IV vary within the following ranges, based on the total amount of these structural units:

structural repeat unit of formula III: 20–50 mol %, and
structural repeat unit of formula IV: 40–60 mol %.

Particular preference is likewise given to yarns comprising as core filaments and preferably also as effect filaments aromatic copolyamides with the structural repeat units of the formulae III and VI where $Ar^1$ is 1,4-phenylene, $Ar^4$ is 1,4-phenylene or a bivalent radical of 4,4'-diaminobenzanilide and X is —NH—; and in particular the proportions of the structural repeat units of the formulae III and VI vary within the following ranges, based on the total amount of these structural units:

structural repeat unit of the formula III: 20–70 mol %, and
structural repeat unit of the formula VI: 20–70 mol %.

Particular preference is likewise given to yarns comprising as core filaments and preferably also as effect filaments aromatic copolyamides with the structural repeat units of the formulae III, IV and VI where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,4- or 1,3-phenylene, Q is —O— or —O-1,4-phenylene-O— and X is —NH—; and in particular the proportions of the structural repeat units of the formulae III, IV and VI vary within the following ranges, based on the total amount of these structural units:

structural repeat unit of the formula III: 10–30 mol %,
structural repeat unit of the formula IV: 10–40 mol %, and
structural repeat unit of the formula VI: 30–70 mol %.

Particular preference is likewise given to yarns comprising as core filaments and preferably also as effect filaments aromatic copolyamides with the structural repeat units of the formulae IV, V and VI where $Ar^1$ is 1,4-phenylene, $Ar^5$ is 1,4-phenylene, $Ar^6$ is 1,4-phenylene or 1,3-phenylene, Q is —O— or —O-1,4-phenylene-O—, $Ar^7$ and $Ar^8$ are each methyl-substituted 1,4-phenylene, Y is a direct C—C bond and X is —NH—; and in particular the proportions of the structural repeat units of the formulae IV, V and VI vary within the following ranges, based on the total amount of these structural units:

structural repeat unit of the formula IV: 10–40 mol %, structural repeat unit of the formula V: 20–60 mol %, and structural repeat unit of the formula VI: 30–70 mol %.

Examples of preferred diamine combinations underlying these preferred aramids comprising the structural repeat units of the formulae III and IV or of the formulae III and VI or of the formulae III, IV and V or of the formulae III, IV and VI or of the formulae IV, V and VI are 1,4-phenylenediamine and 3,4'-diaminodiphenyl ether; 1,4-phenylene-diamine, 4,4'-diaminodiphenylmethane and 3,3'-dichloro-, 3,3'-dimethyl- or 3,3'-dimethoxy-benzidine; and also 1,4-phenylenediamine, 1,4-bis(aminophenoxy) benzene and 3,3'-dichloro-, 3,3'-dimethyl- or 3,3'-dimethoxy-benzidine; and also 1,4-phenylenediamine, 3,4'-diaminodiphenyl ether and 3,3'-dichloro-, 3,3'-dimethyl- or 3,3'-dimethoxy-benzidine; and also 1,4-phenylenediamine, 3,4'-diaminodiphenyl ether and 4,4'-diaminobenzanilide; and also 1,4-phenylenediamine, 1,4-bis (aminophenoxy)-benzene and 3,4'-diaminodiphenyl ether; and also 1,4-phenylenediamine and diamino-2-phenylbenzimidazole; and also 1,4-phenylenediamine, diamino-2-phenylbenzimidazole and 3,3'-dichloro-, 3,3'-dimethyl- or 3,3'-dimethoxy-benzidine; and also 1,4-phenylenediamine, diamino-2-phenylbenzimidazole and 3,4'-diaminodiphenyl ether; and also 3,3'-dichloro-, 3,3'-dimethyl- or 3,3'-dimethoxy-benzidine, diamino-2-phenylbenzimidazole and 1,4-bis (aminophenoxy) benzene; and also diamino-2-phenylbenzimidazole, 3,3'-dichloro-, 3,3'-dimethyl- or 3,3'-dimethoxy-benzidine and 3,4'-diaminodiphenyl ether; and also 1,4-phenylenediamine, diamino-2-phenylbenzimidazole and 1,4-bis (aminophenoxy) benzene.

Aramids which are derived from such diamine combinations and which are preferably useful for the present invention are in part described in EP-A-199,090, EP-A-364,891, EP-A-364,892, EP-A-364,893 and EP-A-424,860.

Preference is given to two-component loop yarns having a yarn linear density of from 100 to 1000 dtex, in particular from 200 to 800 dtex.

As mentioned earlier, the two-component loop yarn of the invention is composed of core and effect filaments. The core filaments are oriented to a much higher degree in the direction of the fiber axis than the effect filaments, which are intermingled and intertwined with the core filaments but which in addition, owing to their greater length, form loops which protrude from the fiber assembly and hence play a significant part in determining the textile properties and the performance characteristics, such as the sewing characteristics, of the yarn according to the invention.

Core and effect filaments generally differ in respect of their linear density. The core filament linear density can be from 0.5 to 8 dtex. The effect filament linear density can be from 0.2 to 4.5 dtex.

The loop yarn of the present invention customarily has a tenacity of more than 50 cN/tex, preferably more than 70 cN/tex. The tenacity is the ratio of the breaking strength to the linear density at break.

The loop yarn of the present invention preferably has an elongation at break of below 5%, in particular of below 4%.

The an elongation at break is the extension of the yarn at break.

Very particular preference is given to two-component loop yarns having a tenacity of more than 50 cN/tex and an elongation at break of below 5%.

In principle, the effect component and also part of the core component of the two-component loop yarns of the present invention can be produced from any synthetic spinnable addition polymers and polycondensation products, for example polyamides, such as aliphatic, aromatic or aliphatic-aromatic polyamides; polyacrylonitrile; polyolefins, such as polyethylene or polypropylene; polyether ketones, such as PEK or PEEK; polyarylene sulfides, such as poly-para-phenylene sulfide; and polyesters, such as polyethylene terephthalate.

Particular preference is given to the use of aromatic polyamides with the above-defined structural repeat units of the formulae I and II as effect component of the yarns of the present invention; particularly preferably, core and effect component consist of one and the same material.

The upper limit for the tenacity of the loop yarns of the present invention also depends on the degree of condensation selected for the aramid material used. The degree of condensation of the aramid is reflected in its solution viscosity. A high degree of condensation, i.e. a high solution viscosity, leads to particularly high tenacities.

The two-component loop yarn of the invention, which is composed of core and effect filaments, is produced by Jet texturing two or more feed yarn strands introduced into the jet at different rates of overfeed. The texturing medium used is a fluid, for example water or in particular a gas which is inert towards the feed yarn strands, in particular air, with or without moistening or with a previously moistened feed yarn.

The invention further provides a process for producing a two-component loop yarn composed of core and effect filaments wherein at least part of the core component consists of aromatic polyamides comprising the structural repeat units of the formulae I and II defined above, comprising the measures of:

a) feeding two or more feed yarn strands at different speeds into a texturing Jet, at least part of the feed yarn strands consisting of aromatic polyamides comprising the structural repeat units of the formulae I and II defined above, b) intermingling the feed yarn strands in the texturing Jet under conditions to form a yarn consisting of core and effect filaments and having loops formed chiefly of effect filaments on its surface, and c) withdrawing this primary two-component loop yarn under tension so that, through reduction in the loop size, said primary yarn becomes mechanically stabilized, and optionally d) heating the stabilized primary yarn to set the yarn structure.

Jet texturing of yarn comprises, as will be known, feeding the filament material into the texturing jet at a higher speed than that at which it is withdrawn there-from. The excess of the feed speed over the withdrawal speed, expressed as a percent of the withdrawal speed, is termed the overfeed. In the process of the invention, then, the yarn strands which are to be mixed with each other, and which in the finished yarn then supply the core or the effect filaments, are fed into the texturing jet at different rates of overfeed. The feed yarn strand which will constitute the core filaments of the yarn according to the invention will usually be fed into the texturing Jet at an overfeed of from 3 to 10%, while the feed yarn strand which will constitute the effect filaments of the yarn according to the invention will usually be overfed at from 10 to 60%.

Owing to this difference in the rate of overfeed, longer lengths of the effect filaments are intermingled in the texturing Jet with shorter lengths of the core filaments, the result being that, in the ready-produced yarn of the invention, the effect filaments form appreciably more arcs and loops than the core filaments, which extend essentially in the direction of the yarn axis. The different overfeeds further make it possible to control the final linear density of the loop yarn. The final linear density $T_S$ of the intermingled yarn is not simply the sum of the linear densities of the feed yarns; the overfeed of the two feed yarns has to be taken into account. The final linear density $T_S$ of the intermingled yarn is accordingly given by the following formula:

$$T_S = T_{St} * (1+(V_{ST}/100)) + T_E * (1+(V_E/100))$$

where $T_{St}$ and $V_{St}$ are the linear density and overfeed of the core feed yarn and $T_E$ and $V_E$ are the linear density and overfeed of the effect feed yarn.

It is customary to use feed yarn strands having different strand and filament linear densities, at least the feed yarn for the core filament consisting of filaments having a tenacity such that the loop yarn final tenacity desired for the field of use in question can be achieved.

Feed yarns for the purposes of the present invention are yarns which are prior to entry into the intermingling jet and are used as core and effect components for forming the loop yarn.

In the feed yarns producing the two-component loop yarns of the invention, the core component is a yarn composed of aromatic polyamides comprising the above-defined structural repeat units of the formulae I and II, a high tenacity yarn, whereas the effect component used can be a customary textile multifilament yarn as well as a high tenacity multifilament yarn.

These feed materials can already be high tenacity multifilament yarns when presented to the texturing apparatus or drawn directly before entry into the texturing Jet.

Preference is given to using core feed yarns having a tenacity at break of at least 100 cN/tex, customarily from 100 to 250 cN/tex, in particular of from 125 to 170 cN/tex.

Further preferred core feed yarns have virtually no heat shrinkage at 180° C.

Further preferred core feed yarns have an elongation at break of not more than 5%, in general within the range from 2 to 4%, preferably 2.5 to 3.2%.

Very particular preference is given to using two feed yarn strands which both consist of filaments having a tenacity at break of at least 150 cN/tex and an elongation at break of 2 to 5%.

After leaving the texturing Jet, the primary two-component loop yarn is withdrawn under tension, so that, through reduction in the loop size, the primary yarn becomes mechanically stabilized. The withdrawal tension is usually at least 0.1 cN/tex. The tension is preferably chosen such that the loops formed remain essentially intact, i.e. are not closed up in the manner of a flower bud to any significant extent, if at all.

Thereafter the stabilized primary yarn is optionally heated to set the yarn structure. It is advantageous to subject the yarn to a hot air treatment at air temperatures of from 200° to 600° C., preferably from 350° to 450° C., at constant length.

The two-component loop yarns of the present invention have the advantages of the conventional two-component loop yarns. For instance, the loops of the individual filaments remain completely intact outside the texturing jet and, by virtue of the entrained air, produce good sewing properties even at high sewing speeds. This advantage is seen in high values for the sewing length to rupture, determined by the method known from DE-A-3,431,832. Furthermore, the two-component loop yarns of the invention are notable for particularly high strength.

It is a particular advantage that the two-component loop yarn of the invention does not have to be twisted. It can be used untwisted for example as sewing yarn.

But, for example for reasons of eye appeal, it is also possible to apply a desired twist to the yarn, for example a twist of about 100 to 300 turns per meter (tpm), in the course of further processing.

The two-component loop yarns of the invention can be used in particular as sewing yarns. This use also forms part of the subject-matter of the invention.

The Example which follows illustrates the invention without limiting it:

The creel is mounted with a bobbin of 440 dtex 300 filament core feed yarn and a bobbin of 220 dtex 150 filament effect feed yarn. Both feed yarns consisted of an aromatic polyamide based on terephthalic acid, paraphenylenediamine, 1,4-bis(4-aminophenyl)-benzene and 3,3'-dimethylbenzidine.

The overfeed between the texturing jet and the subsequent take-off system was 2–15%, preferably 3–8%, for the core end and 10–50%, preferably 15–25%, for the effect end. The temperatures of the feed godets and the supply godets was in each case 250° C. The drawn yarns were guided about the heated supply godets, the yarn transportation speed for the drawing systems being regulated separately. The filament linear density of the feed yarns before entry into the Jet was 1.5 dtex, not only for the core but also for the effect yarn.

After leaving the jet, the loop yarn was mechanically stabilized by withdrawing with a yarn tension of 0.1 cN/tex. Thereafter the yarn was set by passing it through a hot air oven heated to 400° C. Postsetting was carried out by means of a process described in EP-A-569,082.

The loop yarn obtained had the following data:

Yarn linear density: 644 dtex
elongation at break: 4570 cN
Tenacity: 71.0 cN/tex
Breaking extension: 2.1%
Loop tenacity: 54.61 cN/tex

What is claimed is:

1. A two-component loop yarn comprising core filaments and effect filaments, at least part of the core filaments consisting of aromatic copolyamides, wherein the aromatic copolyamides contain the structural repeat units of the formula I and II $$-OC-Ar^1-CO-NH-Ar^2-NH- \quad (I)$$

$$-OC-Ar^1-CO-NH-Ar^3-NH- \quad (II),$$

where $Ar^1$, $Ar^2$ and $Ar^3$ are each independently of the others a bivalent mono- or polycyclic aromatic radical whose free valences are disposed para or meta or comparably parallel, coaxial or angled to each other, and wherein respective monomer components underlying the polymer are selected so as to produce an aromatic polyamide which forms isotropic solutions in organic solvents.

2. The two-component loop yarn of claim 1 wherein the aromatic copolyamide has two structural repeat units of the formula III and IV or of the formula III and VI or of the formula III, IV and V or of the formula III, IV, and VI or of the formula IV, V and VI $$-OC-Ar^1-CO-NH-Ar^4-NH-, \quad (III)$$

$$-OC-Ar^1-CO-NH-Ar^5-Q-Ar^6-NH-, \quad (IV)$$

$$-OC-Ar^1-CO-NH-Ar^7-Y-Ar^8-NH-, \quad (V)$$

-continued

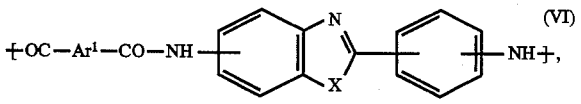

(VI)

where $Ar^1$ and $Ar^4$ are independently of each other a bivalent mono- or polycyclic aromatic radical whose free valences are disposed para or comparably parallel or coaxial to each other, and are in particular monocyclic or bicyclic aromatic radicals, $Ar^5$ and $Ar^6$ are each independently of the other a bivalent mono- or polycyclic aromatic radical whose free valences are disposed para or comparably parallel or coaxial to each other, or where $Ar^6$ additionally may be a bivalent mono- or polycyclic aromatic radical whose free valences are disposed meta or comparably angled to each other, Q is a C—C bond or a group of the formula —O—, —S—, —$SO_2$—, —O-phenylene-O— or alkylene, $Ar^7$ and $Ar^8$ each have one of the meanings defined for $Ar^5$ and $Ar^6$, Y has one of the meanings defined for Q or may additionally be a group of the formula —HN—CO—, and X is a group of the formula —O—, —S— or in particular —$NR^1$—, where $R^1$ is alkyl, cycloalkyl, aryl, aralkyl or in particular hydrogen.

3. The yarn of claim 2 wherein the aromatic copolyamide has the structural repeat units of the formula III, IV and V where $Ar^1$ is 1,4-phenylene, $Ar^4$ is 1,4-phenylene or a bivalent radical of 4,4'-diaminobenzanilide, $Ar^5$, $Ar^6$ and $Ar^7$ are each 1,4-phenylene, $Ar^8$ is 1,3-phenylene, Q is —O-1,4-phenylene-O— and Y is —O—; and in particular the proportions of the structural repeat units of the formula III, IV and V vary within the following ranges, based on the total amount of these structural units:

structural repeat unit of the formula III: 40–60 mol %,
structural repeat unit of the formula IV: 1–20 mol %, and
structural repeat unit of the formula V: 15–40 mol %.

4. The yarn of claim 2 wherein the aromatic copolyamide has the structural repeat units of the formula III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-substituted 1,4-phenylene, Q is —O-1,4-phenylene-O— and Y is a C—C bond; and in particular the proportions of the structural repeat units of the formula III, IV and V vary within the following ranges, based on the total amount of these structural units:

structural repeat unit of the formula III: 10–30 mol %,
structural repeat unit of the formula IV: 10–30 mol %, and
structural repeat unit of the formula V: 10–60 mol %.

5. The yarn of claim 2 wherein the aromatic copolyamide has the structural repeat units of the formula III, IV and V where $Ar^1$ is 1,4-phenylene, $Ar^4$ is 1,4-phenylene or a bivalent radical of 4,4'-diaminobenzanilide, $Ar^5$ and $Ar^6$ are each 1,4-phenylene, $Ar^7$ and $Ar^8$ are each methyl-substituted 1,4-phenylene, Q is —O— and Y is a C—C bond; and in particular the proportions of the structural repeat units of the formula III, IV and V vary within the following ranges, based on the total amount of these structural units:

structural repeat unit of formula III: 10–30 mol %,
structural repeat unit of formula IV: 10–50 mol %, and
structural repeat unit of formula V: 10–60 mol %.

6. The yarn of claim 2 wherein the aromatic copolyamide has the structural repeat units of the formula III and IV where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,3-phenylene and Q is —O—; and in particular the proportions of the structural repeat units of the formula III and IV vary within the following ranges, based on the total amount of these structural units:

structural repeat unit of the formula III: 20–50 mol %, and
structural repeat unit of the formula IV: 40–60 mol %.

7. The yarn of claim 2 wherein the aromatic copolyamide has the structural repeat units of the formula III and VI where $Ar^1$ is 1,4-phenylene, $Ar^4$ is 1,4-phenylene or a bivalent radical of 4,4'-diaminobenzanilide and X is —NH—; and in particular the proportions of the structural repeat units of the formula III and VI vary within the following ranges, based on the total amount of these structural units:

structural repeat unit of the formula III: 20–70 mol %, and
structural repeat unit of the formula VI: 20–70 mol %.

8. The yarn of claim 2 wherein the aromatic copolyamide has the structural repeat units of the formula III, IV and VI where $Ar^1$ is 1,4-phenylene, $Ar^4$ is 1,4-phenylene or a bivalent radical of 4,4'-diaminobenzanilide, $Ar^5$ is 1,4-phenylene, $Ar^6$ is 1,4- or 1,3-phenylene, Q is —O— or —O-1,4-phenylene-O— and X is —NH—; and in particular the proportions of the structural repeat units of the formula III, IV and VI vary within the following ranges, based on the total amount of these structural units:

structural repeat unit of formula III: 10–30 mol %,
structural repeat unit of the formula IV: 10–40 mol %, and
structural repeat unit of the formula VI: 30–70 mol %.

9. The yarn of claim 2 wherein the aromatic copolyamide has the structural repeat units of the formula IV, V and VI where $Ar^1$ is 1,4-phenylene, $Ar^5$ is 1,4-phenylene, $Ar^6$ is 1,4-phenylene or 1,3-phenylene, Q is —O— or —O-1,4-phenylene-O—, $Ar^7$ and $Ar^8$ are each methyl-substituted 1,4-phenylene, Y is a direct C—C bond, and X is —NH—; and in particular the proportions of the structural repeat units of the formula IV, V and VI vary within the following ranges, based on the total amount of these structural units:

structural repeat unit of the formula IV: 10–40 mol %,
structural repeat unit of the formula V: 20–60 mol %, and
structural repeat unit of the formula VI: 30–70 mol %.

10. The two-component loop yarn of claim 1 having a yarn linear density of from 100 to 1000 dtex.

11. The two-component loop yarn of claim 1 whose tenacity is more than 50 cN/tex.

12. The two-component loop yarn of claim 1 having an elongation at break is below 4%.

13. The two-component loop yarn of claim 1 having a tenacity of more than 50 cN/tex and an elongation at break of below 4%.

* * * * *

UNITED STATES PATENT AND TRADEMARK OFFICE

CERTIFICATE OF CORRECTION

PATENT NO. : 5,645,935
DATED : July 8, 1997
INVENTOR(S) : Wilbert Kemper, et. al.

It is certified that error appears in the above-indentified patent and that said Letters Patent is hereby corrected as shown below:

Column 5, line 61, "The an" should read -- An --.

Column 8, line 35, "elongation at break" should read -- Breaking strength --; and
line 37, "Breaking extension" should read -- Elongation at break --.

Signed and Sealed this

Twenty-first Day of October 1997

*Attest:*

Bruce Lehman

BRUCE LEHMAN

*Attesting Officer*

*Commissioner of Patents and Trademarks*